US005259457A

United States Patent [19]

Williamson, Jr.

[11] Patent Number: 5,259,457

[45] Date of Patent: Nov. 9, 1993

[54] SAFETY VALVE, SEALING RING AND SEAL ASSEMBLY

[75] Inventor: Jimmie R. Williamson, Jr., Carrollton, Tex.

[73] Assignee: Halliburton Co., Dallas, Tex.

[21] Appl. No.: 967,242

[22] Filed: Oct. 27, 1992

Related U.S. Application Data

[62] Division of Ser. No. 726,312, Jul. 5, 1991, Pat. No. 5,199,494.

[51] Int. Cl.[5] ..... E21B 34/10

[52] U.S. Cl. ..... 166/321; 166/332; 277/206 R

[58] Field of Search ..... 166/319, 321, 332; 277/206 R, 206 A, 236, 27; 92/243

[56] References Cited

U.S. PATENT DOCUMENTS

| | | | |
|---|---|---|---|
| 2,420,039 | 5/1947 | Frisby | 277/206 X |
| 2,455,202 | 11/1948 | Ware | 277/206 X |
| 2,739,856 | 3/1956 | Martin | 92/243 |
| 2,780,290 | 2/1957 | Natho | 166/72 |
| 2,798,561 | 7/1957 | True | 166/224 |
| 2,889,183 | 6/1959 | Peras | 277/206 X |
| 3,373,998 | 3/1968 | Bialkowski | 277/236 X |
| 4,049,052 | 9/1977 | Arendt | 166/183 |
| 4,161,219 | 7/1979 | Pringle | 166/324 |
| 4,378,931 | 4/1983 | Adams, Jr. | 251/58 |
| 4,444,266 | 4/1984 | Pringle | 166/324 |
| 4,452,310 | 6/1984 | Pringle et al. | 166/319 |
| 4,467,870 | 8/1984 | Langham | 166/321 |
| 4,473,122 | 9/1984 | Tamplen | 166/373 |
| 4,475,598 | 10/1984 | Brakhage, Jr. et al. | 166/321 |
| 4,527,630 | 7/1985 | Pringle | 166/321 |
| 4,583,596 | 4/1986 | Davis | 166/332 |
| 4,669,547 | 6/1987 | Pringle | 166/321 |
| 4,691,776 | 9/1987 | Pringle | 166/319 |
| 4,716,969 | 1/1988 | Pringle | 166/321 |
| 4,796,705 | 1/1989 | Carmody et al. | 166/323 |
| 4,877,257 | 10/1989 | Ide | 277/206 X |
| 4,945,993 | 8/1990 | Dickson et al. | 166/321 |
| 4,951,753 | 8/1990 | Eriksen | 166/321 X |
| 4,976,317 | 12/1990 | Leismer | 166/321 |
| 4,986,357 | 1/1991 | Pringle | 166/321 X |
| 4,987,826 | 1/1991 | Deppert et al. | 92/168 |

FOREIGN PATENT DOCUMENTS

| | | | |
|---|---|---|---|
| 122476 | 10/1946 | Australia | 277/206 |
| 2844906 | 4/1980 | Fed. Rep. of Germany | 277/206 |
| 554093 | 5/1957 | Italy | 277/206 |
| 1142857 | 2/1969 | United Kingdom | 277/206 |

*Primary Examiner*—Hoang C. Dang
*Attorney, Agent, or Firm*—Jennifer R. Daunis

[57] ABSTRACT

A downhole, inline well safety shutoff valve has a spring-loaded, normally closed flapper shutoff valve element that may be opened by a downwardly driven movement of an operator tube coaxially and slidably disposed within the tubing string bore. The operator tube is vertically driven by a rod structure disposed in an offset passageway in the safety valve housing and operated by fluid control pressure transmitted thereto from the surface. To substantially preclude undesirable communication in the passageway between pressurized production fluid and pressurized rod control fluid, the rod structure is slidably carried within a specially designed seal structure including a cylindrical sleeve coaxially received in the offset passageway, and a sealing ring captively retained between the top end of the sleeve and an annular ledge formed in the passageway. The sealing ring functions to create a dynamic seal around the rod side surface and a static seal between the ring and the interior passageway surface. Upwardly and downwardly facing annular seating surfaces are formed on the lower end of the sleeve. In response to upward movement of the rod relative to the sleeve, an adapter secured to the reduced diameter rod portion engages and forms a static fluid seal with the downwardly facing seating surface. In response to downward movement of the rod relative to the sleeve, the rod undercut engages and forms a static fluid seal with the upwardly facing seating surface.

5 Claims, 5 Drawing Sheets

SAFETY VALVE, SEALING RING AND SEAL ASSEMBLY

This is a division of application Ser. No. 07/726,312, filed Jul. 5, 1991, now the U.S. Pat. No. 5,199,494.

BACKGROUND OF THE INVENTION

This invention relates to a sealing ring and seal assembly which provide a fluid and pressure barrier and seal and also to a surface controlled subsurface safety valve used in the oil and gas industry, in particular, to a hydraulically operated valve with metal-to-metal seal systems, which utilize the sealing ring and/or seal assembly to accomplish an effective fluid barrier.

DESCRIPTION OF RELATED ART

It is common practice to complete oil and gas producing wells with safety systems including a subsurface safety valve controlled from the well surface to shut off fluid flow in the well tubing string. Generally, such a valve is controlled in response to fluid pressure conducted to the valve from a remote location at the well surface via a small diameter conduit (control line) permitting the well to be selectively shut in as well conditions require. The surface controller is typically equipped to respond to emergency conditions such as fire, broken flow lines, oil spills, etc. Frequently, it is necessary to conduct well servicing operations through a subsurface safety valve. The well servicing operations may require extending a wireline tool string through the subsurface safety valve. Examples of such services are pressure and temperature testing. Additional well servicing procedures are required to retrieve damaged downhole equipment. These procedures result in periodic opening and closing of the safety valve. Subsurface safety valves are shown in the following U.S. Pat. Nos. 3,860,066; 3,882,935; 4,344,602; 4,356,867; and 4,449,587. The present invention is shown in one embodiment with a flapper type valve closure in the subsurface safety valve. U.S. Pat. No. 3,860,066 teaches that a longitudinally movable operator tube may control the opening and closing of ball, poppet, or flapper type valve closure means within a subsurface safety valve.

For some well completions, it is desirable to install the safety valve at deep depths. For these completions a small piston area is one way to minimize the effect of hydrostatic fluid pressure from the control line leading to the well surface. Pistons having a small cross section in comparison to the cross section of the complete valve assembly have been used in surface controlled subsurface safety valves (SCSSV). Examples of such pistons are shown in:

| U.S. Pat. No. | Title |
|---|---|
| 2,780,290 | Surface Controlled Subsurface Tubing Pressure Shut-Off Valve |
| 2,798,561 | Blowout Preventer for Wells |
| 4,049,052 | Subsurface Annulus Safety Valve |
| 4,161,219 | Piston Actuated Well Safety Valve |
| 4,444,266 | Deep Set Piston Actuated Well Safety Valve |
| 4,716,969 | Hydraulic Valve Actuating Means for Subsurface Safety Valve |
| 4,796,705 | Subsurface Well Safety Valve |

U.S. Pat. No. 4,716,969 discloses a subsurface safety valve having a hydraulic valve actuating means including flow sealing valves which are positioned out of direct contamination with the biasing fluid for reducing the possibility of gas escaping to the fluid control passageway.

U.S. Pat. No. 4,796,705 discloses a safety valve with an axially shiftable actuating sleeve operable to move a valve head from a closed to an open position with a first and second rod or spindle and cooperating cylinder. The second cylinder has only abutting contact with the actuating sleeve and may be utilized to effect the movement of the actuating sleeve in the event of the failure of the primary cylinder. Latches are disclosed which prevent return movement of the secondary cylinder or secondary rod pistons, thus locking the valve head in an open position.

U.S. Pat. No. 4,378,931 teaches a surface controlled subsurface safety valve which is operated by a reciprocating hydraulic motor or piston mounted on the exterior of the safety valve housing.

One important requirement of systems such as subsurface safety valves and other systems such as packers and the like is that the valve effectively seal so as to provide a fluid and pressure barrier when needed. Since a tubing retrievable safety valve cannot be easily removed from the well bore for routine maintenance, any failure of a fluid seal or accumulation of debris within the safety valve can be very expensive to correct. All sealing systems are subject to failure depending upon the operating environment and design of the seals. Often times a seal between two metal members is desired. For some environments these "metal-to-metal" seals produce longer life compared to elastomeric materials; however, elastomeric materials and other non-metal, non-elastomeric materials provide unique advantages as well. Elastomeric, polymeric, and metal-to-metal seal systems have all been used in SCSSV's. Examples of metal-to-metal seal systems are shown in:

| U.S. Pat. No. | Title |
|---|---|
| 4,452,310 | Metal-to-Metal High/Low Pressure Seal |
| 4,467,870 | Fluid Pressure Actuator for Subterranean Well Apparatus |
| 4,475,598 | Ball Valve Actuating Mechanism |
| 4,527,630 | Hydraulic Actuating Means for Subsurface Safety Valve |
| 4,583,596 | Dual Metal Seal for a Well Safety Valve |

U.S. Pat. No. 4,452,310 discloses a metal-to-metal seal on the inside of the cylinder which includes first and second metal seals which are attached to the piston at the top of the piston and which slide with the piston to open and close the valve.

U.S. Pat. No. 4,723,606 teaches an operator tube and a valve closure means which can be cycled open and closed with a wireline tool.

U.S. Pat. No. 4,945,993 discloses a surface controlled subsurface flapper type safety valve with a metal-to-metal sealing system which blocks well fluids from entering the control line when the valve is closed.

U.S. Pat. No. 4,987,826 discloses an automotive cylinder-piston rod unit with a sealing ring which is held against the rod by a sealing pressure application ring clamp. The entirety of the sealing ring fits tightly against the rod.

There is a need for one or more continuous seals between the rod and the inside wall of the safety valve or some other member which will prevent leakage of both hydraulic pressure fluids and well fluids as well as pressure from above and below the rod into the interface between the rod and the inside wall of the safety valve and the bore. Leakage control is necessary so that the rod will maintain sufficient pressure to shift downward and upward, and then remain seated as desired, thus facilitating the opening and closing of the valve.

A sealing ring is desired which will effectively seal against fluid and pressure leakage in some type of well system such as a safety valve or packer. Also desired is a seal mechanism to retard fluid and pressure leakage from within the well.

What is desired is a dynamic seal which provides a continuous seal which retards fluid and pressure leakage and yet is unaffected by high temperatures and pressures of a well for a period of many years.

The previously listed patents are incorporated by reference for all purposes in this application.

SUMMARY OF THE INVENTION

The present invention relates to a sealing ring for forming a fluid and pressure barrier which comprises a sealing sleeve portion which extends axially and surrounds a cylindrical member wherein the sealing sleeve portion has at least one lip and wherein each lip has a smaller diameter than the diameter of the sealing sleeve portion so that each lip can sealingly engage the external surface of the cylindrical member and a radially outwardly directed flange portion to retard fluid leakage around the sealing ring. Preferably, the sealing ring forms a fluid and pressure barrier in the offset passageway and a safety valve for downhole use in a well.

The present invention also relates to a tubing-retrievable safety valve having a housing connectable with a well tubing string and a bore therethrough for communicating well fluid flow with the tubing string, a valve closure means mounted in the housing for movement between a first open position and second closed position, and an operator tube in the housing to control movement of the valve closure means between its first position and its second position. The operator tube normally moves in response to control fluid pressure acting on a rod means and a spring biasing the operator tube to move in opposition to the piston. A sealing ring is disposed in the safety valve in contact with a housing means so as to be stationary relative to the rod means and to form a fluid and pressure barrier between the rod means and the housing means and which comprises a sealing sleeve portion which extends axially and surrounds the rod wherein the sealing sleeve portion has at least one lip and wherein each lip of the sealing sleeve portion has a smaller diameter than the diameter of the sealing sleeve portion so that each lip sealingly engages the external cylindrical surface of the rod and wherein the sealing ring additionally comprises a radially outwardly directed flange portion to retard fluid and pressure leakage. At least a portion of the rod means is sufficiently smooth and hard so as to slide within the bore of the sealing ring.

The safety valve may include a rod retainer and seal means in contact with the housing means which has an upper static seat and a lower static seat which contact to form a fluid and pressure barrier with a spherical or angular surface on the rod when the valve closure means is in the first position, and with an adapter of the rod when the valve closure means is in the second position.

The safety valve can include the sealing ring without the rod retainer and seal means or can include the rod retainer and seal means without the sealing ring, or can include both the sealing ring and the rod retainer and seal means.

The present invention also relates to a rod seal assembly comprising a rod with an undercut to provide a reduced diameter portion of a cylindrical member below the undercut, an adapter on said rod to assist in forming a first fluid and pressure barrier, a rod retainer and seal means which is stationary relative to the rod and which surrounds at least a portion of the length of the rod and where at least a portion of the rod is sufficiently hard and smooth so as to slide through the rod retainer and seal means, where the rod retainer and seal means has an upper static seat and a lower static seat which contact to form a first fluid and pressure barrier with a spherical or angular surface of the rod and the adapter of the rod, respectively, and a sealing ring disposed around the rod and contacting the top of the rod retainer and seal means so as to be stationary relative to the rod, which comprises a sealing sleeve portion which extends axially and surrounds the rod wherein the sealing sleeve portion has at least one lip, wherein each lip has a diameter smaller than the diameter of the sealing sleeve portion so that each lip sealingly engages the external surface of the rod where the sealing ring forms a second fluid and pressure barrier.

DESCRIPTION OF THE PREFERRED EMBODIMENT

Figure 1:
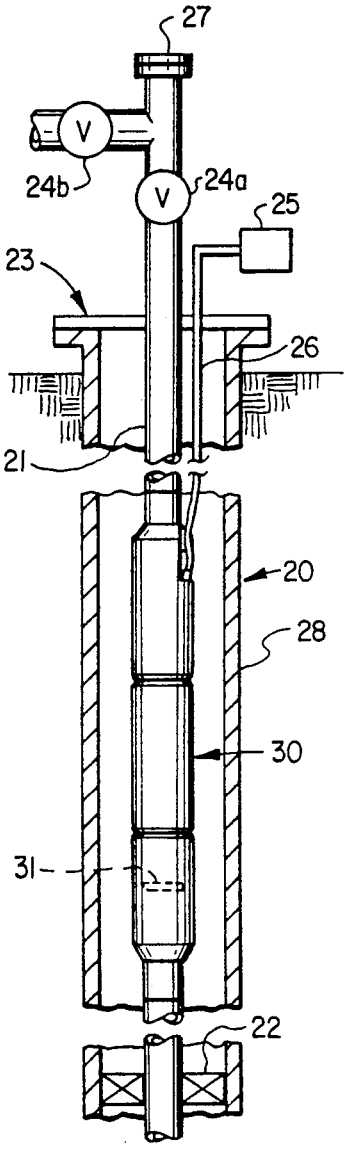
FIG. 1 is a schematic view in section and elevation of a typical well completion including a tubing-retrievable subsurface safety valve with a flapper type valve closure means.

In the following description, like parts are designated throughout the specification and drawings with the same reference numerals. The drawings are not necessarily to scale. Portions of some parts have been exaggerated to better illustrate details of the present invention.

Referring to FIG. 1, well completion 20 includes casing string 28 extending from the well surface to a hydrocarbon producing formation (not shown). Tubing string 21 is concentrically disposed within casing 28 and extends from wellhead 23 through production packer 22 which seals between tubing string 21 and casing 28. Packer 22 directs formation fluids such as oil, gas, water, and the like into tubing string 21 from perforations (not shown) in casing 28 which admit formation or well fluids into the well bore. For purposes of this application, "fluid" includes oil, gas, water and the like, whether in the liquid or gaseous state. Well fluids frequently carry sand or other debris which may accumulate at locations in tubing string 21 having low fluid velocity. Flow control valves 24*a* and 24*b* at the well surface control fluid flow from tubing string 21. Wellhead cap 27 is provided on wellhead 23 to permit servicing well 20 via tubing string 21 by wireline techniques which include the installation and removal of various downhole tools (not shown) within tubing string 21. Other well servicing operations which may be carried out through tubing string 21 are bottom hole temperature and pressure surveys.

Surface controlled subsurface safety valve 30 embodying the features of the invention is installed in well completion 20 as a part of tubing string 21 to control fluid flow to the well surface via tubing string 21 from a downhole location. Safety valve 30 is operated by control fluid conducted from hydraulic manifold 25 at the well surface via control line conduit 26 which directs the control fluid signal to safety valve 30. Hydraulic manifold 25 generally includes pumps, a fluid reservoir, accumulators, and control valves for the purpose of providing control fluid pressure signals for holding valve 30 open or allowing valve 30 to close when desired. Manifold 25 also includes apparatus which functions in response to temperature, surface line leaks, and other emergency conditions under which well 20 should be shut in.

Figure 8:
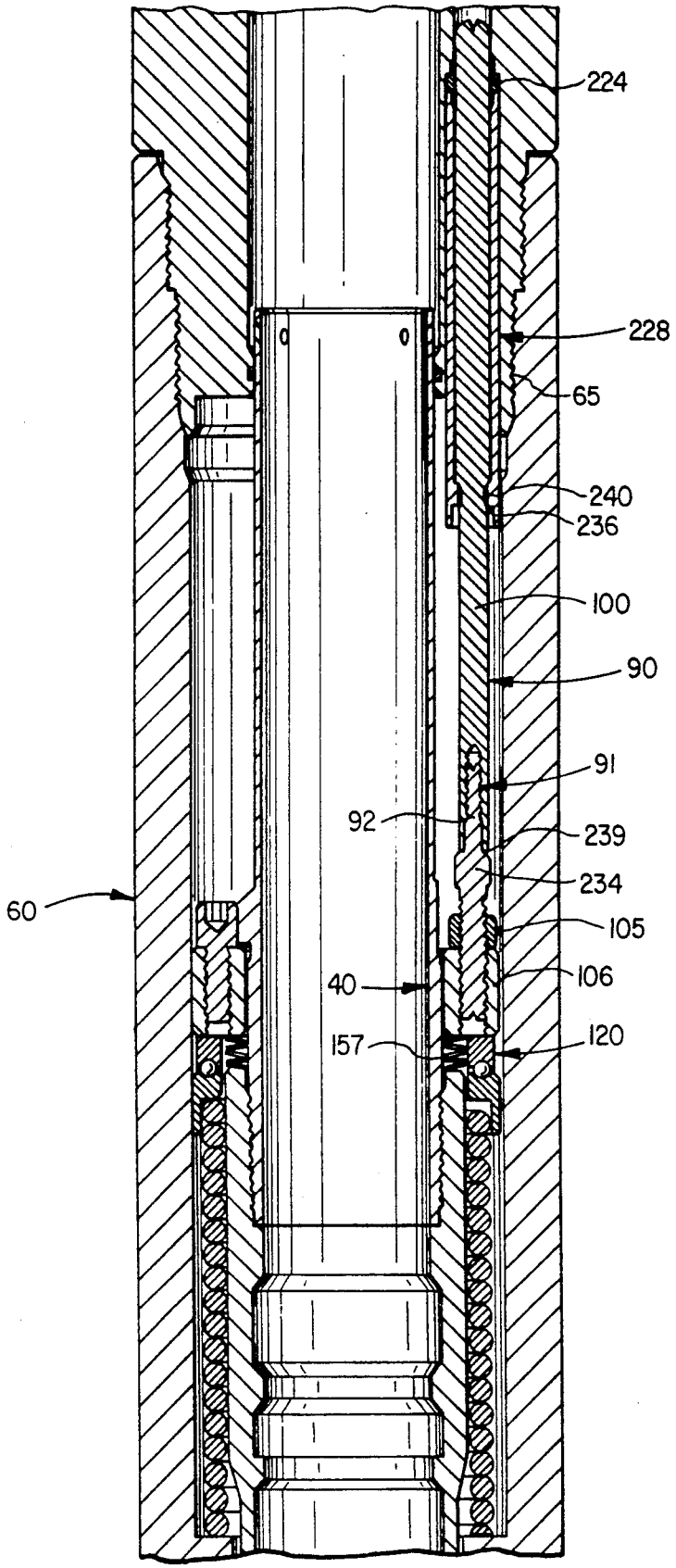
FIG. 8 is a drawing in section showing the combination of sealing ring, rod means, and rod retainer and seal means.

Safety valve 30 includes flapper type valve closure means 31 mounted on hinge 34 for swinging between its closed position schematically represented in FIG. 1 and its open position in FIG. 8 which permits fluid flow through tubing string 21. When a predetermined pressure signal is applied to safety valve 30 through control line 26 from manifold 25, valve closure means or flapper 31 is maintained in its first or open position. When control pressure signal is released, valve 30 is allowed to move to its second or closed position.

Figure 2A:
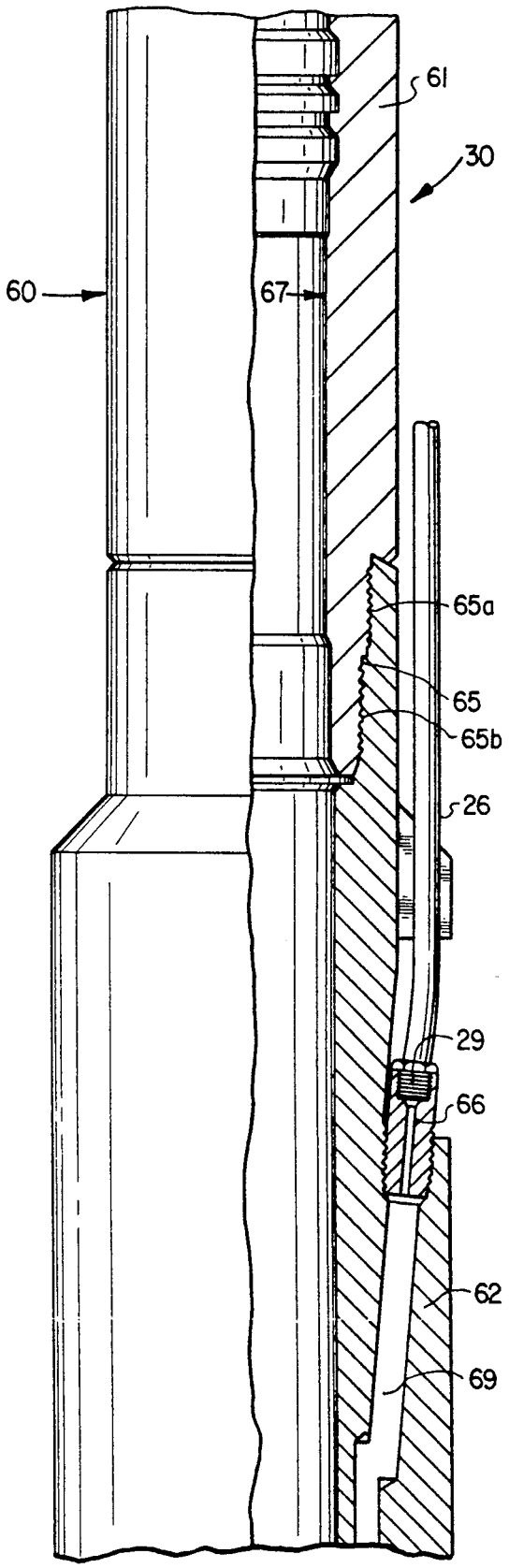
FIGS. 2A, 2B and 2C taken together form a longitudinal view in section with portions broken away of the subsurface safety valve and operator tube incorporating the present invention showing the safety valve in its closed position.
Figure 2B:
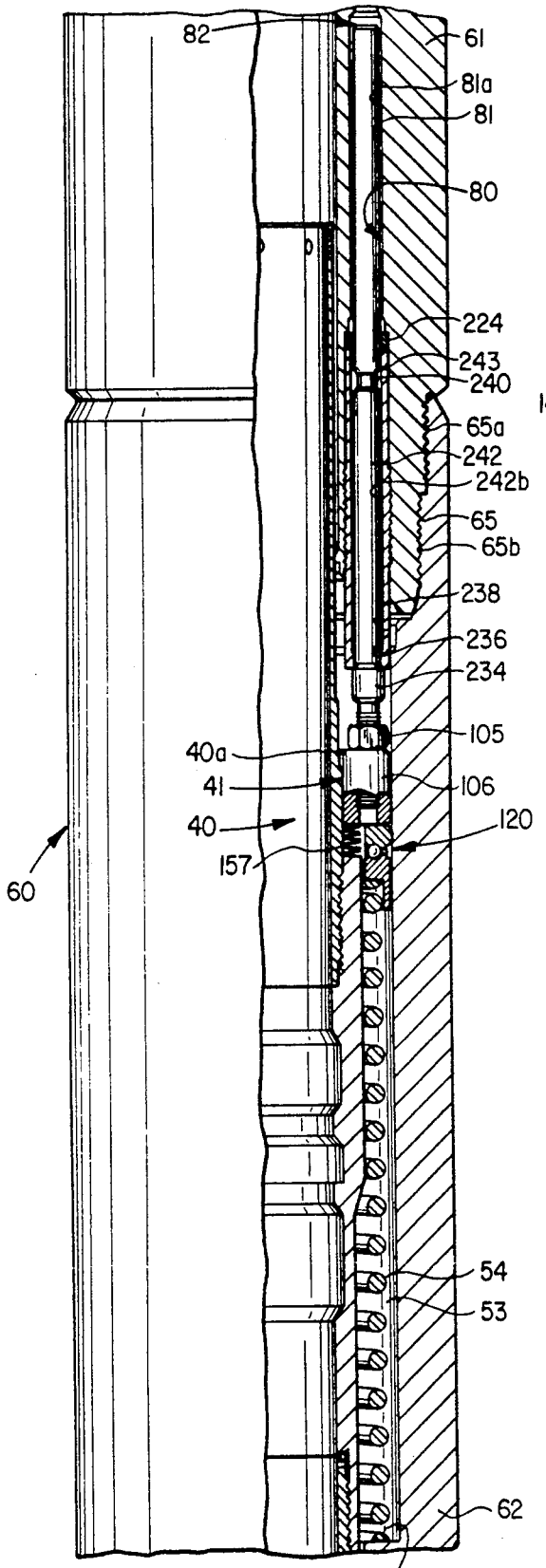
Figure 2C:
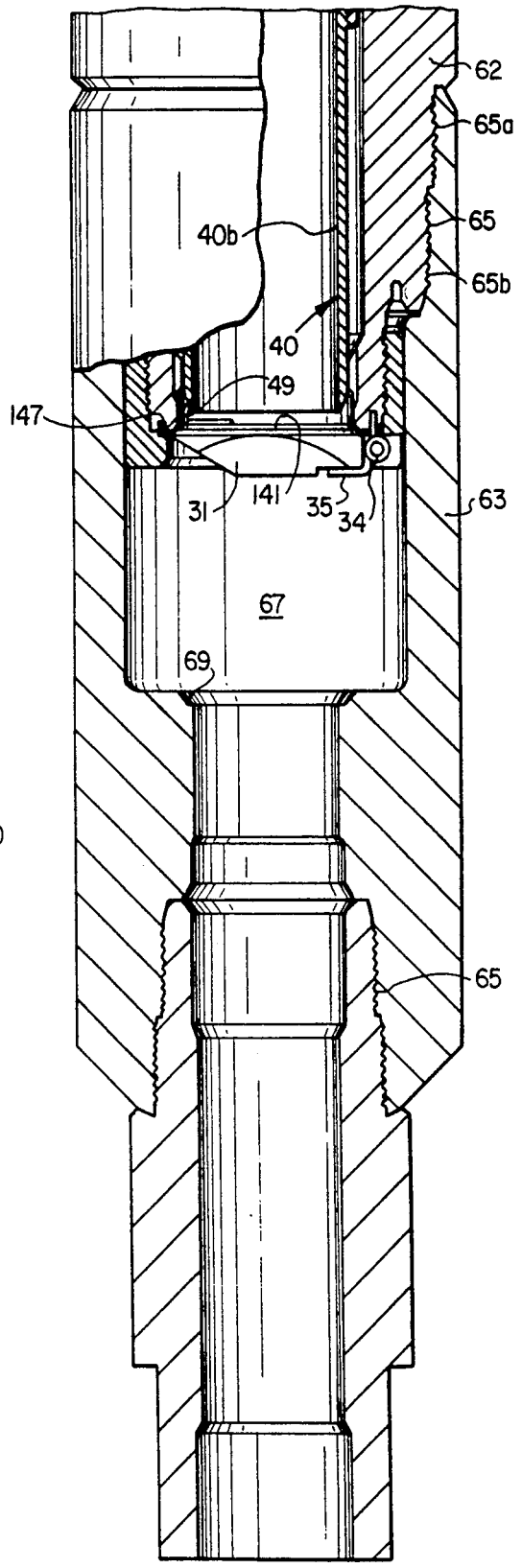

Details for construction of the preferred form of valve 30 are shown in FIGS. 2A, 2B and 2C. Subsurface safety valve 30 has housing means 60 formed by housing subassemblies 61, 62, and 63 which are suitably interconnected by threaded joints 65. Subassemblies 61, 62, and 63 could be interconnected by welded joints or by a combination of threads and elastomeric seals. Welding is sometimes unsatisfactory due to requirements for heat treating before and after. Elastomeric seals in some environments (high pressure, high temperature gas) have a tendency to fail during pressure transients. Threaded joints 65 are preferred because they have mechanical strength comparable to a welded connection and a metal-to-metal seal. U.S. Pat. No. 2,992,019 discloses threads and a metal-to-metal seal system similar to threaded joint 65.

Threaded joint 65 is sometimes referred to as a two-step thread because the diameter of threaded portion 65*a* is substantially larger than threaded portion 65*b*. Depending upon the type of materials used to manufacture housing means 60, diameter 65*b* and the length of threaded portions 65*a* and 65*b* may be increased or decreased so that threaded joint 65 has mechanical strength equal to or greater than any other portion of housing means 60. Threaded joint 65 is particularly desirable because it allows many alternatives with respect to designing housing means 60 but is relatively easy to manufacture and assemble.

Housing means 60 can be generally described as a long thick walled cylinder with longitudinal bore 67 extending therethrough. The ends of housing subassemblies 61 and 63 may be internally or externally threaded to provide means on opposite ends of housing means 60 for connection with tubing string 21. A lockout sleeve (not shown) could be incorporated into safety valve 30 if desired to hold valve closure means 31 open. Lockout sleeves which can be shifted by wireline tools to permanently or temporarily hold valve closure means 31 open are known in the art.

Housing subassembly 61 has threaded connection 29 to attach control line 26 to safety valve 30. Control fluid pressure signals are communicated from the well surface via control line 26, threaded connection 29, drilled passageway 66, and offset passageway 80. Passageway 80 is machined in the wall of housing subassembly 61 parallel with but offset from longitudinal bore 67.

Operator tube 40 is slidably disposed within longitudinal bore 67 to shift valve closure means 31 from its second, closed position as shown in FIG. 2C to its first, open position as shown in FIG. 8. Operator tube 40 is constructed from two or more generally hollow, cylindrical sections designated 40*a* and 40*b*. Rod means 90 may be a piston in a rod-piston arrangement, disposed in housing means 60 offset from longitudinal bore 67, moves operator tube 40 in response to control fluid pressure from the well surface. A portion of rod means 90 is slidably disposed in offset passageway 80.

Rod means 90 has two main components—seal assembly 91 and cylindrical rod 100. Seal assembly 91 includes seat insert 92. Seat insert 92 is a threaded rod.

The exterior of operator tube 40 and the interior of housing subassembly 62 partially defines annulus 50 therebetween. Cylindrical rod 100 extends from the lower end of housing subassembly 61 into annulus 50. Cylindrical rod 100 and seal assembly 91 are then threaded together to form rod means 90 and partially disposed within offset passageway 80 of housing subassembly 61.

Biasing means or spring 54 is carried on the exterior of operator tube 40 in spring chamber 53 which is a portion of annulus 50. Biasing means 54 applies a force to slide operator tube 40 longitudinally opposite from the force of control fluid pressure in piston chamber 82 acting on piston means 90. When control fluid pressure in chamber 82 is decreased below a preselected value, spring 54 moves operator tube 40 longitudinally upward to allow valve closure means 31 to return to its second, closed position. Spring 35 coiled around hinge 34 assists in moving flapper 31 to its closed position.

Operator tube 40 could be designed to allow spring 54 to directly contact a shoulder on its exterior. Such design is frequently used in commercially available subsurface safety valves. Compression of spring 54 and expansion of spring 54 produces torsional forces in addition to longitudinal forces.

Longitudinal force from spring 54 is transmitted to the exterior of operator tube 40. Longitudinal force from rod means 90 is transmitted to the exterior of operator tube 40.

Longitudinal force to shift valve closure means 31 to its open position is initiated by supplying a preselected amount of control fluid pressure to piston chamber 82. Rod means 90 converts control fluid pressure to a longitudinal force which is transferred via rod 100. Belleville spring washers or some other suitable spring 157 is positioned below load ring 106. Longitudinal force on load ring 106 via springs 57 is transferred to operator tube 40. The longitudinal force moves operator tube 40 to open valve closure means 31.

At the same time as load ring 106 is applying longitudinal force, longitudinal force is also being applied to spring 54 via thrust bearing assembly 120. Thus, torsional forces from compressing spring 54 are isolated from rod means 90.

Longitudinal force to shift operator tube 40 in the opposite direction to allow valve closure means 31 to move to its closed position is supplied primarily by biasing means or spring 54. First control fluid pressure in rod chamber 82 is decreased below a preselected value. Spring 54 can then expand. Longitudinal force from expansion of spring 54 is applied to operator tube 40 via bearing assembly 120 and load ring 106. During expansion of spring 54, load ring 106 contacts the bottom of flange 41 to return operator tube 40 to its second position. Bearing assembly 120 isolates operator tube 40 and rod means 90 from torsional forces generated by expansion of spring 54.

Figure 3:
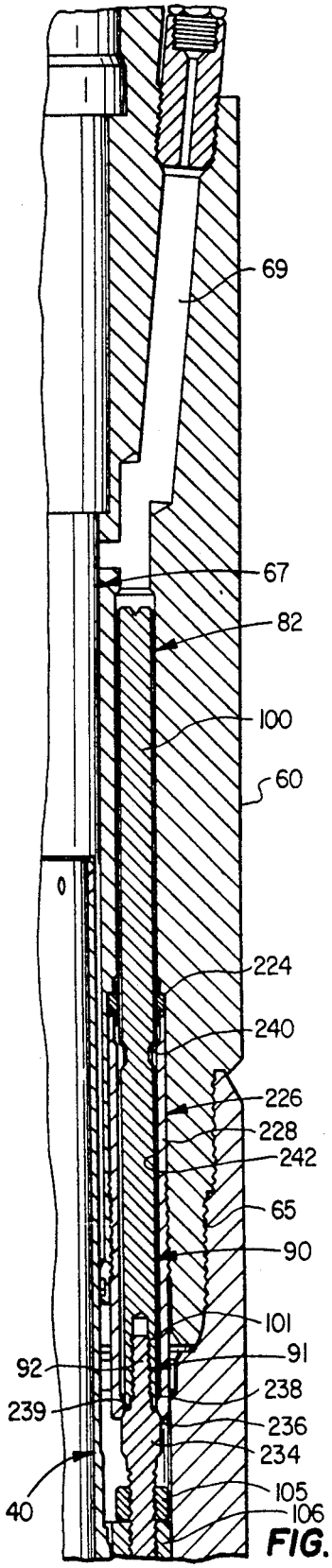
FIG. 3 is a drawing in longitudinal section with portions broken away of the subsurface safety valve shown in FIGS. 2A, 2B and 2C in its closed position.

Referring to FIG. 3, rod means 90 comprises a seal assembly 90 and either a cylindrical member, piston or rod 100. Rod 100 is partially disposed within a passageway offset from the longitudinal bore and a seal assembly is secured to one end of the rod. Rod 100 may contain an undercut to provide a reduced diameter portion 242 of rod 100 below a spherical or angular surface 243 and an adapter portion 234 to assist in forming a fluid barrier.

Sealing ring 224 is shown around rod 100. Rod retainer and seal means 226 surrounds at least a portion of the length of rod 100. Adapter 234 seats against lower static seat 236 when flapper 31 is closed and spherical or angular surface 243 seats against upper static seat 238 when flapper 31 is open.

Figure 6A:
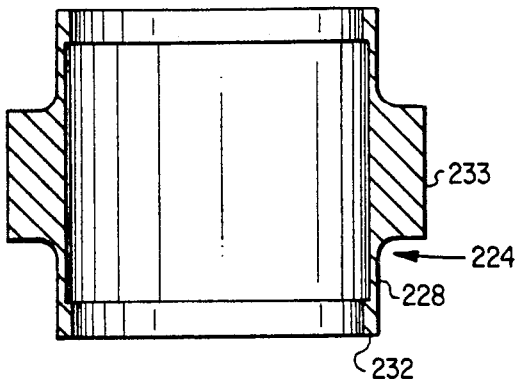
FIGS. 6A, 6B and 6C show various views of the sealing ring.
Figure 6B:
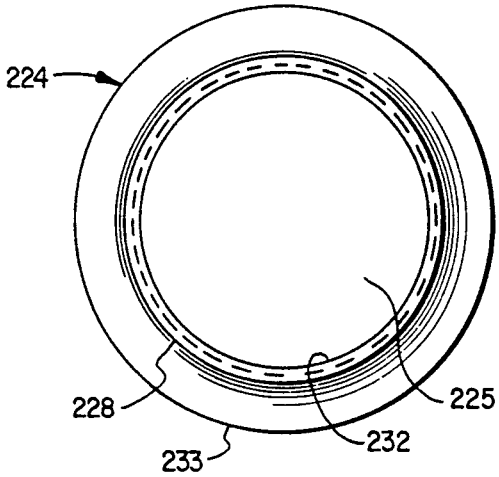
Figure 6C:
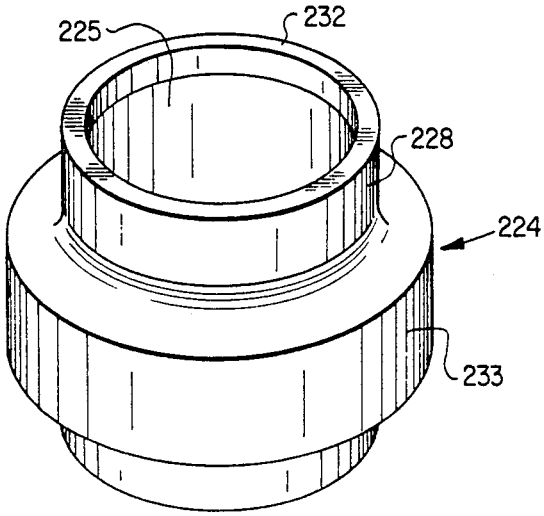

Referring to FIGS. 6A, 6B and 6C, sealing ring 224 is shown. FIG. 6A is a cross sectional view of sealing ring 224, showing flange portion 233 which is directed radially outward from sealing sleeve 228. Lip 232 has a smaller diameter than the diameter of support sleeve portion 228 so that each lip 232 sealingly engages the external surface of cylindrical member 100.

FIG. 6B shows an end view of sealing ring 224, with sealing ring aperture 225, lip 232, flange portion 233 and sleeve 228. Sleeve 228 has a larger inside diameter than the inside diameter of lip 232, and extends axially and surrounds a cylindrical member 100.

FIG. 6C shows a perspective view of sealing ring 224 with sleeve 228, lip 232, aperture 225 and flange portion 233.

Figure 7A:
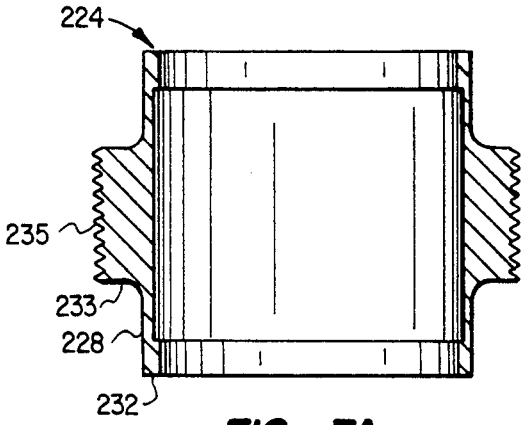
FIGS. 7A, 7B, and 7C show various views of the sealing ring with threaded joints.
Figure 7B:
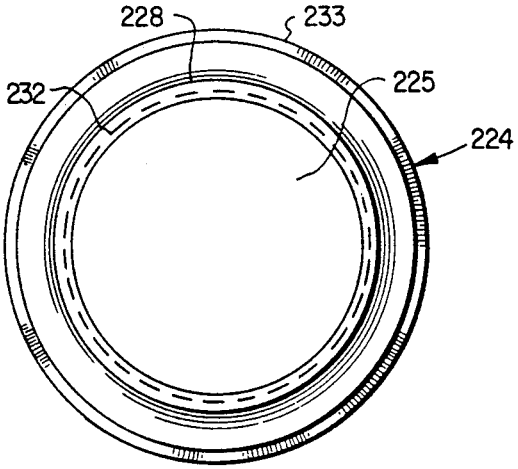
Figure 7C:
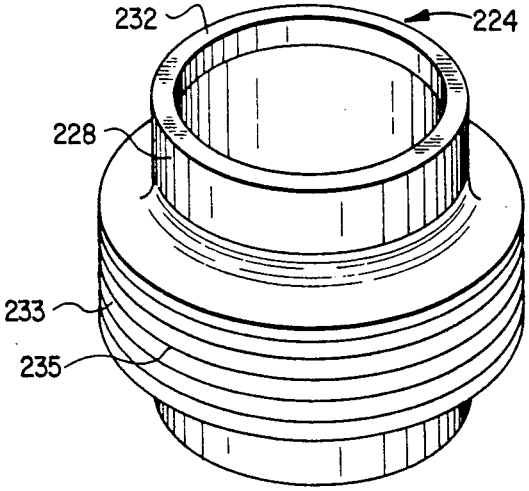

FIGS. 7A, 7B and 7C show sealing ring 224 with threaded joints ("threads") 235. Threads 235 may be optionally used to facilitate interconnection between sealing ring 224 and at least one stationary member within safety valve 30 or some other valve or apparatus including but not limited to a packer, although threads 235 are not required. Sealing ring 224 is attached to some stationary member so ring 224 is stationary relative to rod or cylindrical member 100, so that sealing ring 224 does not move but rod 100 does.

It should be noted that sealing ring 224 may be used in safety valve 30 or in some other type of apparatus such as a packer or other tool or device for use in the oil and gas industry.

Sealing ring 224 fits around cylindrical member 100, rod 100 or piston 100. Rod 100 fits within sealing ring aperture 225, and lip 232 of sleeve 228, having a smaller diameter than the diameter of sleeve 228, and sealingly engages the internal lip of sealing ring 224.

At least a portion of cylindrical member 100 is sufficiently smooth and hard so as to slide within the lips 232 of sealing ring 224. This surface hardening can be accomplished by any one of a variety of methods including, but not limited to, a ceramic coating, a diffusion coating, an iron nitride coating, plating with hard metals, chromium/gold plating, diamond coating, surface heat treatment and the like. Cylindrical member 100 may be made of hardened tool steel, alternatively. A bare metal rod typically has a surface hardness of Rockwell C 29-36. Preferably the cylindrical member of this invention has a surface hardness Rockwell C of at least 50 and most preferably of at least 75. A bare metal rod with a Rockwell C hardness of 35 may be used for this invention, but the mean time to failure (MTTF) or lifetime of the rod might only be about ten (10) years whereas the MTTF for a rod with a Rockwell C of 75 approximates thirty (30) years.

Some surface treatments not only improve the life of cylindrical member or rod but help inhibit corrosion as well. The rod hardness helps to elastically deform lips 232 of sealing ring 224 so that lips 232 fit sufficiently tight against cylindrical member 100 to form a pressure and fluid barrier but not so tightly that cylindrical member 100 cannot slide through sealing ring 224.

The cylindrical member or rod 100 should be sufficiently smooth and round so as to slide within bore 225 of sealing ring 224. The smoothness of cylindrical member 100 in combination with the smoothness of the lips 232 of sealing ring 224 provides a better fluid barrier than would a rough surface. The smoothness of cylindrical member 100 also reduces friction, thus lowering operating pressure requirements. The smoothness also allows cylindrical member 100 to move flapper 31 by way of operator tube 40 to a closed position more easily and faster.

By proportionally scaling the design, the sealing ring 224 can be used for different sizes of diameters of cylindrical member 100 or rod 100.

Preferably, sealing ring 224 is designed so as to fit a subsurface safety valve rod with a diameter from about one-fourth inches to about 2 inches, although the rod diameter can vary for a packer or other tool or device.

Lips 232 conform to each cylindrical member 100 to provide a fluid barrier. Space 240 in FIG. 4 or 5 remains between rod 100 and the inside of sealing sleeve portion 228 and rod 100, although lips 232 contact rod 100 and conform to same.

This seal also acts as a hydraulic pressure barrier to keep pressure from leaking. For example, hydraulic pressure from control line 26 enters offset passageway 80 and pushes cylindrical member 100 down through passageway 80 to compress biasing means or spring 54 within spring chamber 53. This moves operator tube 40 at section **40*a* down so that section 40*b* of operator tube 40 contacts surface 141 of valve closure means or flapper 31 and pushes flapper 31 open. In the event that the pressure from control line 26 leaks past cylindrical member 100 into passageway 80, cylindrical member 100 will not push adequately through passageway 80 nor will it adequately compress spring 54, which results in flapper 31 remaining closed. Thus, it is important that a good barrier seal be formed within passageway 80** between cylindrical member 100 and the housing of safety valve 30.

Pressure and fluids are prevented from leaking from below cylindrical member or rod 100. As the pressure from above cylindrical member 100 decreases and becomes less than the well pressure, spring 54 moves operator tube 40 longitudinally upward to allow valve closure means 31 to return to its closed position. A fluid and pressure tight barrier is desired below cylindrical member 100 in order to keep well fluids and gases below cylindrical member 100 from leaking into the control line 26.

Thus, a first fluid and pressure barrier may be formed by sealing ring 224 and rod 100. A second fluid barrier may be formed by a rod retainer and seal means or metal sleeve 226 and rod 100. Sleeve 226 is placed within passageway 80 in contact with housing means 60 so as to be stationary relative to cylindrical member 100 and which surrounds at least a portion of the length of cylindrical member 100. Preferably, sleeve 226 surrounds cylindrical member 100 partway down cylindrical member 100. Cylindrical member 100 is provided with a spherical or angular surface 243. Cylindrical member 100 has reduced diameter portion 242 below surface 243. Sleeve 226 has upper static seat 238 and lower static seat 236 which may be created by angular or straight cuts in sleeve 226. Any suitable undercut will create seats 236 and 238. There need not be any specific configuration to create reduced diameter portion 242. Spherical or angular surface 243 contacts upper static seat 238 when pressure from control line 26 pushes cylindrical member 100 downward. Surface 243 and upper static seat 238 are both positioned on cylindrical member 100 and rod retainer and seal means or sleeve 226, respectively, so that the end of operator tube 40 contacts and fully opens flapper 31 when surface 243 contacts upper static seat 238. A fluid and pressure barrier or seal is formed at upper static seat 238 and lower static seat 236. This barrier or seal is preferably metal to metal but may be other materials as well. These barriers reduce the amount of electrolytic and chemical corrosion to the rod 240 and seal assembly 91.

Rod means 90 preferably includes rod 100, most preferably rod-piston 100, and seal assembly 91. Seal assembly 91 includes seat insert 92 and adapter 234. Adapter 234 has adapter seat surface 239 which contacts lower static seat 236. When the pressure from the control line 26 decreases, operator tube 40 shifts upward because of spring 54. Adapter 234 of cylindrical member 100 moves up to contact adapter seat surface 239 with lower static seat 236, forming a barrier to fluids and pressure. Thus, a first barrier may be formed by use of (1) sealing ring 224 and (2) cylindrical member 100.

Or, as an alternative, a second barrier may be formed by use of (1) rod retainer and seal means or sleeve 226 which has upper static seat 238 and lower static seat 236 and (2) cylindrical member or rod 100 which has spherical or angular surface 243, reduced diameter portion 242, and adapter 234.

Or, both the first barrier and second barrier may be formed where (1) sealing ring 224, (2) cylindrical member or piston-rod 100 with surface 243 and reduced diameter portion 242, as well as (3) rod retainer and seal means or sleeve 226 with lower static seat 236 and upper static seat 238 are used in combination.

This invention need not be used in a safety valve but may be used as a rod seal assembly in some other device or with some type of cylindrical member 100 other than a rod.

Preferably, sealing ring 224 is made from the materials, or a combination thereof, consisting of metals, elastomers, polymers and advanced composites, although any suitable material will work. Preferably, sealing ring 224 is metal although elastomers, polymers, such as Teflon, a polymer available from Dupont, and advanced composites could be used. The metal seal may also be coated with a thin layer of titanium nitride/-titanium carbide, diamond, gold, or other coating to improve the life of the seal by reducing friction or increasing hardness.

Figure 4:
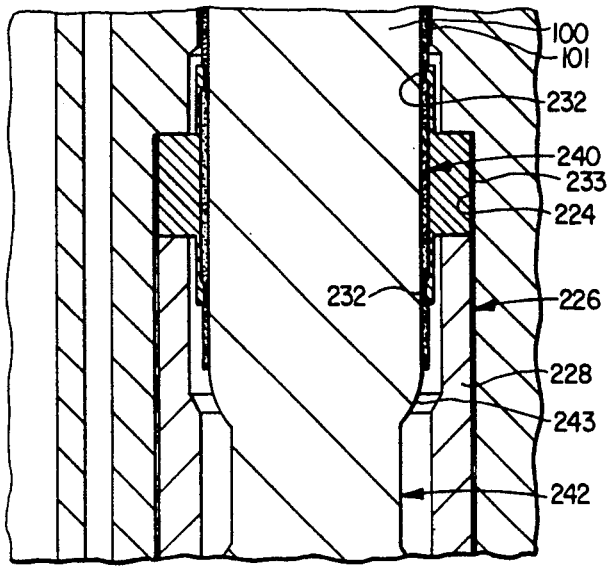
FIG. 4 is a drawing in section showing the sealing ring of this invention around the rod.

Cylindrical member or rod 100 is preferably equal to or greater than Rockwell C 35 and most preferably equal to or greater than 70 Rockwell C in hardness so as to not be too soft and scratch easily. Cylindrical member or rod 100 may be made of a metal such as stainless steel; however, rod 100 may be coated with ceramic coating 101 as shown in FIG. 4. Ceramic coating 101 preferably extends no further down rod 100 than the upper edge of surface 243. Other coatings may be used as long as the coatings do not unduly scratch and scar and they can be polished to be sufficiently smooth.

Figure 5:
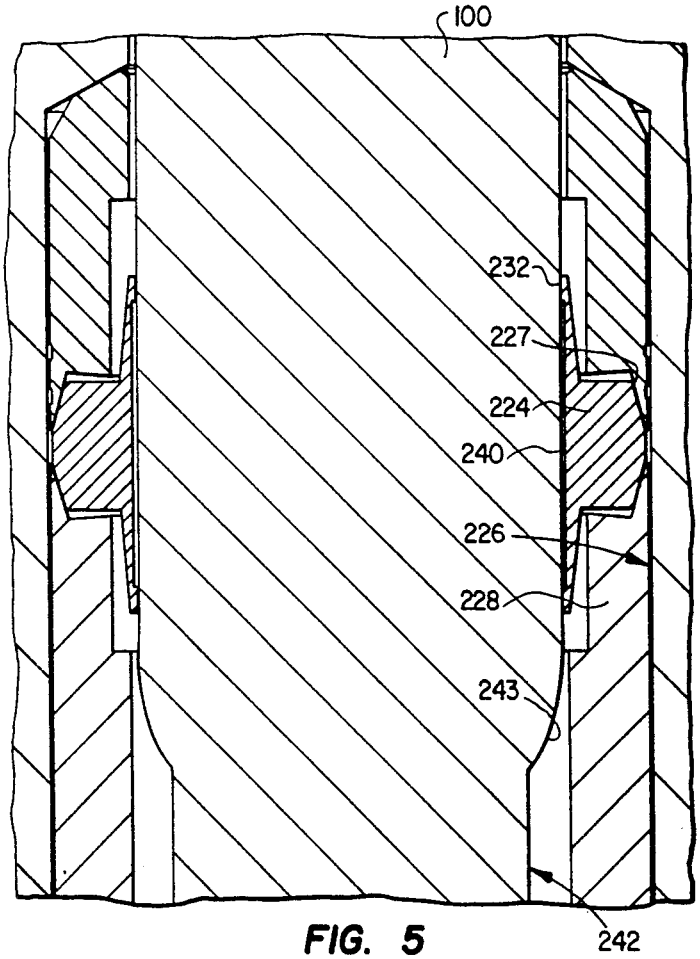
FIG. 5 is an enlarged view in section with portions broken away showing an alternative embodiment of the sealing ring around the rod.

Referring to FIG. 5, an alternative embodiment of sealing ring 224 of FIG. 4 is shown. Sealing ring 224 has flange portion 233 which has tapered edge 227 and tapered sleeve 228. Lips 232 contact cylindrical member or rod 100 with space 240 between cylindrical member or rod 100 and sealing ring 224 wherein only lips 232 of sealing ring 224 contact cylindrical member or rod 100.

The ratio of the thickness of flange portion 233 to the thickness of lips 232 may vary from about 2 to 1 to about 10 to 1 although other ratios may work as well. As the diameter of rod 100 increases, a thicker flange 233 and lips 232 may be used. As the diameter of rod 100 decreases, a thinner flange 233 and lips 232 may be used.

As an example, for a one-half inch rod, a ratio of the thickness of flange portion 233 to the thickness of lips 232 is preferably from about 4 to 1 to about 7 to 1. One of ordinary skill in the art can design sealing ring 224 with appropriate dimensions so as to substantially conform with the above preferred tolerances.

It will become obvious to one of ordinary skill in the art to substitute other materials and parts for those disclosed herein. Thus, various modifications are possible without departing from the scope of the invention. For example, features in one embodiment may be employed in other embodiments of the invention.

I claim:

1. A safety valve for downhole use in a well comprising:

(a) a housing means having a longitudinal bore extending therethrough;

(b) valve closure means mounted in said housing means to control fluid flow through said longitudinal bore;

(c) said valve closure means having a first position which allows fluid flow through said longitudinal bore and a second position which blocks fluid flow therethrough;

(d) an operator tube disposed in said housing means and axially translatable relative thereto to shift the valve closure means from said second position to said first position;

(e) axially shiftable rod means for moving said operator tube in response to control fluid pressure from the surface;

(f) said rod means being disposed within said housing means in a passageway therein offset from said longitudinal bore; and (g) a sealing ring disposed in said offset passageway in contact with said housing means so as to be stationary relative thereto, said sealing ring including a sealing sleeve portion coaxially circumscribing said rod means, wherein said sealing sleeve portion has at least one lip, wherein each lip of said sealing sleeve portion has a smaller diameter than the diameter of said sealing sleeve portion and sealingly and slidingly engages an external side surface of said rod means, said sealing ring being threadingly connected to said housing means.

2. A safety valve for downhole use in a well comprising:

(a) housing means having a longitudinal bore extending therethrough;

(b) valve closure means mounted in said housing means to control fluid flow through said longitudinal bore;

(c) said valve closure means having a first position which allows fluid flow through said longitudinal bore and a second position which blocks fluid flow therethrough;

(d) an operator tube disposed in said housing means and axially translatable relative thereto to shift the valve closure means from said second position to said first position;

(e) axially shiftable rod means for moving said operator tube in response to control fluid pressure from the surface;

(f) said rod means being at least partially ceramic and being disposed within said housing means in a passageway therein offset from said longitudinal bore; and (g) a sealing ring disposed in said offset passageway in contact with said housing means so as to be stationary relative thereto, said sealing ring including a sealing sleeve portion coaxially circumscribing said rod means, wherein said sealing sleeve portion has at least one lip, wherein each lip of said sealing sleeve portion has a smaller diameter than the diameter of said sealing sleeve portion and sealingly and slidingly engages an external side surface of said rod means.

3. A safety valve for downhole use in a well comprising:

(a) housing means having a longitudinal bore extending therethrough;

(b) valve closure means mounted in said housing means to control fluid flow through said longitudinal bore;

(c) said valve closure means having a first position which allows fluid flow through said longitudinal bore and a second position which blocks fluid flow therethrough;

(d) an operator tube disposed in said housing means and axially translatable relative thereto to shift the valve closure means from said second position to said first position;

(e) axially shiftable rod means for moving said operator tube in response to control fluid pressure from the surface;

(f) said rod means being disposed within said housing means in a passageway therein offset from said longitudinal bore; and (g) a sealing ring disposed in said offset passageway in contact with said housing means so as to be stationary relative thereto, said sealing ring including a sealing sleeve portion coaxially circumscribing said rod means, wherein said sealing sleeve portion has at least one lip, wherein each lip of said sealing sleeve portion has a smaller diameter than the diameter of said sealing sleeve portion and sealingly and slidingly engages an external side surface of said rod means, said sealing sleeve portion having first and second opposite ends, and said at least one lip comprising first and second lips respectively formed on said first and second ends of said sealing sleeve portion.

4. A safety valve downhole use in a well comprising:

(a) housing means having a longitudinal bore extending therethrough;

(b) valve closure means mounted in said housing means to control fluid flow through said longitudinal bore;

(c) said valve closure means having a first position which allows fluid flow through said longitudinal bore and a second position which blocks fluid flow therethrough;

(d) an operator tube disposed in said housing means and axially translatable relative thereto to shift the valve closure means from said second position to said first position;

(e) axially shiftable rod means for moving said operator tube in response to control fluid pressure from the surface;

(f) said rod means being disposed within said housing means in a passageway therein offset from said longitudinal bore; and (g) a sealing ring disposed in said offset passageway in contact with said housing means so as to be stationary relative thereto, said sealing ring including a sealing sleeve portion coaxially circumscribing said rod means, wherein said sealing sleeve portion has at least one lip, wherein each lip of said sealing sleeve portion has a smaller diameter than the diameter of said sealing sleeve portion and sealingly and slidingly engages an external side surface of said rod means.

said sealing ring additionally comprising a radially outwardly directed annular flange portion engaging said housing means and forming a static fluid seal within said offset passageway circumferentially around said sealing sleeve portion, said annular flange portion being threadingly connected to said housing means within said offset passageway.

5. A safety valve for downhole use in a well comprising:

housing means having a longitudinal bore extending therethrough, and a passageway offset from said longitudinal bore;

valve closure means mounted in said housing means for controlling fluid flow through said longitudinal bore, said valve closure means being movable relative to said housing means between first and second positions respectively permitting and precluding fluid flow through said longitudinal bore;

an operator tube disposed in said housing means and axially translatable relative thereto to shift said valve closure means from said second position thereof to said first position thereof;

axially shiftable rod means disposed in said offset passageway for moving said operator tube in response to control fluid pressure from the surface of the well; and sealing means for forming dynamic and static seals circumscribing an axial section of said rod means and operating to essentially preclude pressurized fluid flow between opposing sections of said offset passageway on opposite ends of said axial rod means section, said sealing means including:

sealing sleeve means disposed in said offset passageway and coaxially circumscribing said axial section of said rod means, said sealing sleeve means slidingly and sealingly engaging said rod means along only axially spaced portions of said sealing sleeve means to dynamically seal axially spaced circumferential portions of said axial section of said rod means, and cooperating means on said housing means and an axial section of said sealing sleeve means for forming an annular static seal that outwardly circumscribes said sealing sleeve means.

* * * * *